United States Patent [19]

Becker

[11] Patent Number: 4,884,773

[45] Date of Patent: Dec. 5, 1989

[54] COMPUTER TERMINAL STAND

[75] Inventor: Joachim H. Becker, Aberdeen, Md.

[73] Assignee: J. M. Huber Corporation, Locust, N.J.

[21] Appl. No.: 301,727

[22] Filed: Jan. 26, 1989

[51] Int. Cl.[4] ..... A47B 37/00

[52] U.S. Cl. ..... 248/639; 248/918; 108/93

[58] Field of Search ..... 248/1 A, 1 B, 1 C, 1 E, 248/1 I, 1 J, 639, 676, 680, 163.1; 108/6, 152, 1, 92, 93, 90, 59, 150; D6/474, 420, 426; D34/21, 17

[56] References Cited

U.S. PATENT DOCUMENTS

| | | | |
|---|---|---|---|
| D. 274,586 | 7/1984 | Cope | D6/474 |
| D. 287,319 | 12/1986 | Ugalde | D34/21 |
| D. 296,143 | 6/1988 | Bettess | D34/21 |
| 1,427,249 | 8/1922 | Weston | 108/59 |
| 3,016,650 | 1/1962 | Magers | 108/93 |
| 3,358,621 | 12/1967 | Szacsko | 108/92 |
| 4,428,631 | 1/1984 | Cope et al. . | |
| 4,491,375 | 1/1985 | Ugalde . | |
| 4,567,835 | 2/1986 | Reese | 248/1 E |
| 4,590,866 | 5/1986 | Schairbaum . | |
| 4,640,199 | 2/1987 | Zigman . | |
| 4,668,026 | 5/1987 | Lapeyre et al. . | |
| 4,669,789 | 6/1987 | Pemberton . | |
| 4,696,522 | 9/1987 | Lowe . | |

FOREIGN PATENT DOCUMENTS

| | | | |
|---|---|---|---|
| 128263 | 12/1984 | European Pat. Off. | 108/6 |

*Primary Examiner*—Robert W. Gibson, Jr.
*Assistant Examiner*—Robert A. Olson
*Attorney, Agent, or Firm*—Wall and Roehrig

[57] ABSTRACT

A compact computer support stand that includes an open frame having a pair of vertically disposed front legs and a second pair of vertically disposed shorter rear legs. A keyboard table is horizontally disposed from the top of the front legs so that the table extends forwardly from the frame. An inclined monitor platform is mounted at one end in the top part of the rear legs and extends upwardly at an angle. The other end of the platform is supported between the front legs of the frame upon a horizontally disposed bar. Clamps are provided to hold a monitor upon the inclined platform. A rectangular bracket is connected between the two pairs of legs beneath the incline platform. A shelf is seated upon the bracket upon which is supported the disk drive of the computer.

7 Claims, 2 Drawing Sheets

COMPUTER TERMINAL STAND

BACKGROUND OF THE INVENTION

This invention relates to a computer stand and, in particular, to a compact computer stand that can be easily moved from place to place and in which the computer monitor is mounted so that the operator stress and eye fatigue is considerably reduced.

In U.S. Pat. No. 4,640,199 to Zigman there is described a computer terminal work station in which the visual display terminal or monitor is mounted behind the keyboard upon a platform so that the screen of the monitor can be moved by a complex brake mechanism between a vertical and horizontal position to help eliminate glare and to better accommodate operators who wear bi- or tri-focal eyeglasses. The work station is basically a cabinet that is designed to shield the monitor for overhead lighting. The cabinet has one open end at which the operator is seated. The components of the terminal are for the most part hidden inside the cabinet and therefore difficult to reach. As a consequence, the cabinet must be dismantled to gain access to various parts of the unit. This, of course, makes the adjusting and maintaining of the unit difficult and time consuming.

The enclosed box-like structure is not only confining but affords the operator no table space upon which he or she may place books and papers generally required to perform a computer related task. Rather than increasing operator efficiency, these confined work stations actually have the opposite effect on productivity.

A similar computer support terminal cabinet is disclosed by Lapeyre et al in U.S. Pat. No. 4,668,026. Here again, the cabinet has the shape of an open sided box. The monitor is buried inside the box-like structure to shield it from ambient light. The disc drive is set on the top of the cabinet over the operator's head and cannot be reached without difficulty. As in the previously noted Zigman patent, the Lapeyre device affords little if any, access to the terminal components and provides an extremely cramped and confining work area. It also appears that the cabinet is dedicated to one specific computer terminal and cannot be adopted to accept other units.

Pemberton in U.S. Pat. No. 4,669,789 discloses a computer desk having a hinged top which, when raised, provides access to a computer terminal mounted inside the desk. The computer components occupy most of the desk space and leave little or no extra space for drawers and the like. Furthermore, the desk top must be completely cleared each time the top is raised to place the terminal in an operative position.

Schairbaum, in U.S. Pat. No. 4,590,866, also discloses a desk of somewhat similar construction to that disclosed by Pemberton wherein the monitor is suspended beneath a transparent desk top by means of an adjustable bracket. By selectively positioning the bracket, the monitor can be viewed by the operator seated at any given location about the desk. Again, the computer is confined to a single location and cannot be moved to another work station.

Cope et al, in U.S. Pat. No. 4,428,631, recognizes the need for a computer terminal stand that can be easily stored when not in use or, alternatively, can be shared by a number of workers situated at different work stations. The Cope et al device has a caster mounted frame that supports the horizontally aligned keyboard over which is supported a copy support shelf. Above and behind the copy support shelf is mounted an adjustable monitor platform. The monitor platform can be tilted upwardly so that the monitor screen looks down at an operator seated at the keyboard. This, of course, makes viewing of the screen extremely difficult particularly for operators required to wear bi-focal or tri-focal eyeglasses. An operator seated at the keyboard must constantly raise his or her head to view the screen. This can cause neck problems and increase operator fatigue. Cope et al makes no provision for storing a disc drive within the stand and apparently the stand can only be used with a terminal having a combined monitor and disc drive.

SUMMARY OF THE INVENTION

It is therefore an object of the present invention to improve computer terminal stands.

It is a further object of the present invention to provide a small and compact computer stand that can be easily moved from place to place or stored when not in use.

A further object of the present invention is to provide a small mobile computer terminal stand that can be adapted to support a wide range of computer terminals and which has an open frame construction that provides ready access to all component parts of the computer.

Another object of the present invention is to provide an open frame stand for a computer terminal that has an adjustable platform for supporting the terminal monitor behind and below the keyboard table so that an operator seated at the keyboard who is wearing bi-focal or tri-focal eyeglasses can view the monitor with a minimum amount of head movement and discomfort.

These and other objects of the present invention are attained by means of a computer terminal stand that includes a frame having a pair of spaced front legs and a second pair of spaced rear legs; the front legs being longer than the rear legs. A keyboard table is vertically disposed from the front pair of legs so that it protrudes outwardly from the frame. A monitor platform is mounted at one end on top of the rear pair of legs. The monitor extends upwardly at an angle with the other end resting upon a cross-member suspended between the front legs. Accordingly, the screen of a monitor mounted upon the platform is situated at eye level with an operator seated at the keyboard table and is tilted upwardly at an angle for easy reading, particularly by a person wearing eyeglasses having bi- or tri-focal lenses. Adjustable clamps are provided to selectively position the monitor upon the platform. A horizontally disposed shelf is suspended between the legs upon a bracket and is arranged to support the disc drive of the computer terminal. Casters are mounted in the bottom part of the legs which permit the stand to be readily moved from place to place.

BRIEF DESCRIPTION OF THE DRAWINGS

For a better understanding of these and other objects of the present invention reference shall be made to the following detailed description of the invention which is to be read in conjunction with the following drawings, wherein.

DESCRIPTION OF THE INVENTION

Figure 1:
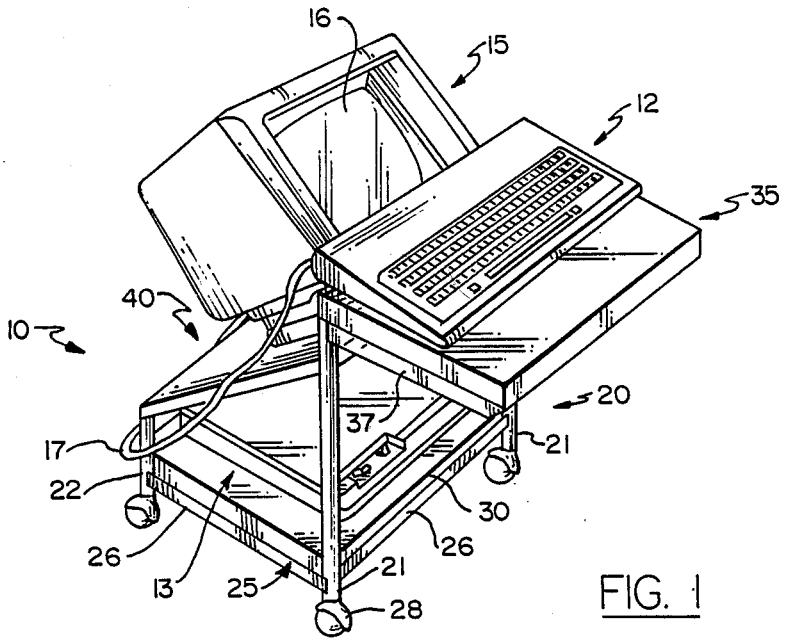
FIG. 1 is a prespective view showing the computer stand of the present invention with a computer terminal unit mounted there upon.

Turning now to the drawings, and in particular to FIG. 1, there is shown a compact computer stand, generally referenced 10 used to support the component parts of a typical computer terminal unit. For the purposes of this disclosure, a computer terminal unit shall mean a unit consisting of a keyboard 12, an individual disc drive 13 containing memory and other program related circuitry, and a monitor 15 having a screen 16 for providing a visual presentation. The components of the terminal unit are all interconnected by appropriate leads, as for example lead 17. As shall become evident from the disclosure below, the open construction of the present stand provides for free access to all terminal components so that the leads can be easily connected and necessary adjustments made without having to remove the components from the stand or having to dismantle the stand. It shall be further noted that the present stand is not dedicated to a single computer terminal and can accommodate all types and makes of systems without modification or change.

With further reference to the remaining figures, the stand consists of an open frame generally referenced 20 that includes a first pair of front legs 21–21 and a second pair of rear legs 22–22. The legs are preferably hollow tubular members. The rear legs of the frame are shorter than the front legs for the reasons which will become apparent below. The two pair of legs are joined by means of a horizontally disposed rectangular bracket 25. The bracket consists of angle members 26–26 that are welded or otherwise secured to the legs. The bracket serves to join the legs in assembly and to help support the legs in vertical alignment. Casters 28–28 of any suitable design are mounted in the bottom of the legs and provide a means by which the stand can be easily rolled from one location to another.

A flat shelf 30 (FIG. 2) made of wood or fiberboard is mounted inside the legs upon the bracket 25. Although not shown, the shelf may be secured to the bracket by suitable fastening means, such as screws or the like, to prevent the bracket from becoming dislodged from the frame and also to provide additional strength and rigidity to the stand.

A horizontally disposed desk 35 is mounted upon the top section of the front legs which extends outwardly from the front of the frame. The table consists of a bracket 37 that is attached as by welding to the top section of the front legs and is arranged to support a work table 38. The work table provides a horizontally disposed surface upon which can be seated the keyboard 12 (FIG. 1) of the computer terminal unit. The front legs of the stand have a vertical length such that an operator seated at the desk has easy access to the keyboard. The work table preferably is made of wood or fiberboard and is secured to the bracket by screws or the like (not shown).

Figure 4:
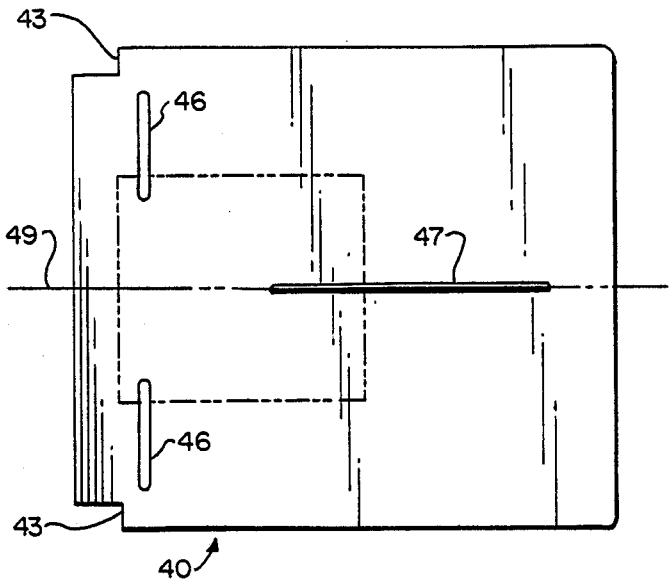
FIG. 4 is a top plan view of the monitor platform utilized in the present computer stand.
Figure 3:
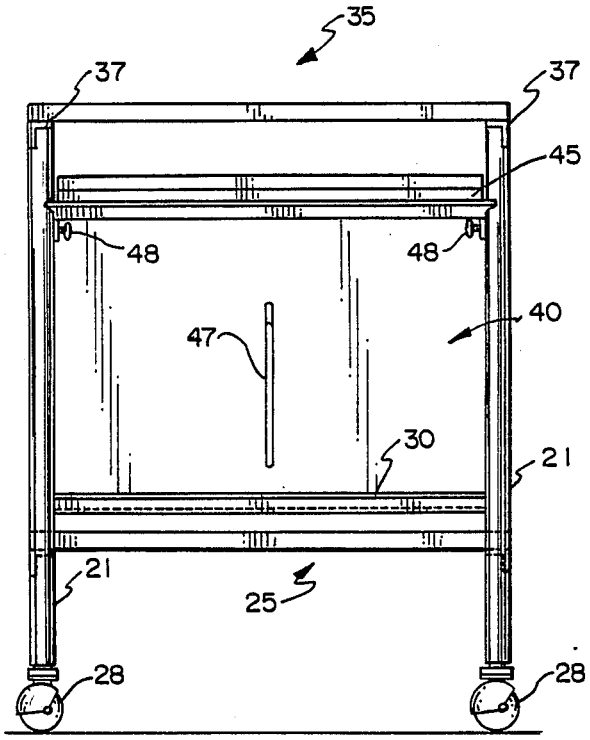
FIG. 3 is a front elevation of the computer stand shown in FIG. 2.

A flat monitor support platform 40 is mounted at an incline in the frame behind the keyboard table. The platform is generally rectangular in shape and is attached at its lower end to the top of the shorter rear legs by hinged members 42–42. The hinged members may be inserted directly to the open ends of the hollow legs or secured thereto by any other suitable means. The upper corners of the platform have cut out shoulders 43–43 (FIG. 4) that are sized to permit the upper part of the platform to move inside the two front legs of the frame. A horizontally disposed cross member 45 is attached between the two front legs of the frame directly beneath the keyboard table and serves as a rest against which the upper part of the platform is seated. Preferably, the horizontal position of the cross member can be vertically adjusted so that the platform can be set at a desired angle. Thumb screws 48 that are threadable in spaced vertically hole formed in the opposed front legs 21–21 are used for this purpose.

Although the platform illustrated in the present embodiment can be angularly adjusted, it is within the scope of the present invention to fixedly attach both ends of the platform to the frame to support the platform at a desired inclination.

The monitor support platform is fabricated of wood or fiberboard and has a pair of opposed laterally aligned slotted holes 46–46 formed in the upper section thereof. A longitudinally aligned slotted hole 47 is also formed within the platform below the lateral slots and is aligned along the central axis 49 of the platform. An angle-shaped stop member 50 (FIG. 2) is slidably contained within the longitudinal slotted hole by means of a threaded locking bolt 51. As shown by the dotted outline in FIG. 2, the stop member can be moved to any desired position along the length of the longitudinal slotted hole by simply loosening and tightening the locking bolt.

Figure 2:
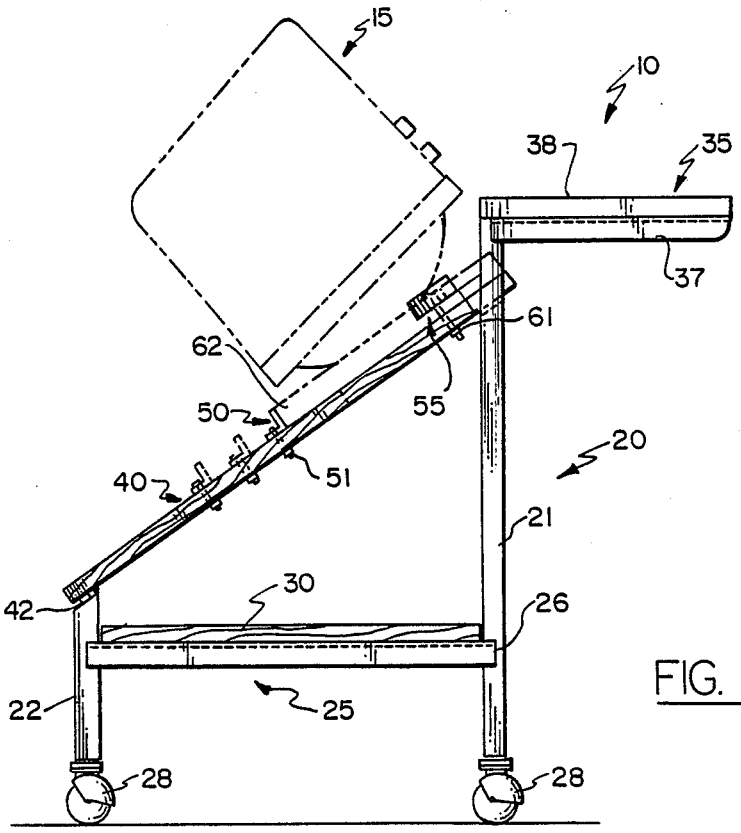
FIG. 2 is an enlarged side elevation of the computer stand shown in FIG. 1 with the terminal components removed.
Figure 5:
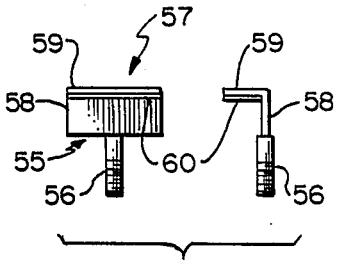
FIG. 5 shows two views of a clamp used to secure the terminal monitor to the platform.

A clamping member 55, as illustrated in FIG. 5, is also contained within each of the lateral slotted holes. The clamps are for locking the base 62 of a monitor unit to the platform. Each clamping member includes a threaded shank 56 and an angle shaped upper body 57 having a vertical leg 58 that is joined to the shank and horizontal leg 59 that is lined with a felt pad 60. In assembly, the threaded shank of the clamp is passed through one of the lateral slots and is secured in place by means of a nut 61 (FIG. 2). The horizontal leg of the member is passed over the base 62 of the monitor and the member is drawn down by tightening the nut thus locking the base against the top surface of the platform. The stop member is then brought into contact with the back edge of the base and is locked in place to further secure the monitor in an inclined position on the platform. The clamps and the stop may be adjusted by the operator to place the screen of the monitor at an elevation such that the screen can be easily read with a minimum amount of head and eye movement. This greatly reduces the amount of fatigue experienced by an operator using similar type devices.

It should be further noted that the present stand is extremely compact and completely mobile so that the entire unit can be moved easily and conveniently between work stations or alternatively stored in an out of the way place.

While this invention has been disclosed with specific reference to the particular embodiment above, the invention is not limited to this embodiment and this application is intended to cover any modifications and changes that may come within the scope of the following claims.

What is claimed is:

1. A computer terminal support stand that includes:

an open frame having a pair of vertically disposed front legs and a pair of vertically disposed rear legs, said pair of front legs being longer than said pair of rear legs, a keyboard table horizontally disposed from the top of said front legs so that the table extends forwardly from said frame, an inclined platform mounted at one end in the top part of said rear legs and extending upwardly at an angle with the other end of said platform being supported by said front legs, said platform having adjustable means for mounting a computer monitor thereon so that the viewing screen of the monitor can be selectively positioned in reference to the keyboard table, said adjustable means further including a clamping means that is slidably contained within the platform for securing a monitor to said platform, a horizontally disposed rectangular shaped bracket mounted between the two pair of legs beneath the inclined platform, and a shelf mounted upon said bracket for supporting a disc drive.

2. The stand of claim 1 wherein the front legs and the rear legs of the frame are hollow tubular members and which further includes caster means mounted in the bottom of each leg whereby the stand can be rolled from place to place.

3. The stand of claim 1 wherein said other end of the platform is positioned below the level of the keyboard table whereby the screen of a monitor mounted upon the platform can be set for easy reading by an operator seated at the keyboard table.

4. The support stand of claim 1 wherein said platform includes hinged means for attaching said one end to the rear legs of the frame, and further includes a horizontally disposed bar secured between the front legs of the frame upon which the other end of said platform rests.

5. The support structure of claim 4 wherein said platform is cut out on both sides thereof for receiving therein the front legs of said frame.

6. The support stand of claim 5 further including adjustable fastening means for securing the horizontal bar to the front legs of the frame whereby the bar can be set at a desired height.

7. The support stand of claim 1 wherein said adjustable means further includes a stop means slidably contained in said platform for contacting the back of the monitor to prevent the monitor from moving down the incline platform.

* * * * *